United States Patent [19]

Rudick

[11] Patent Number: 4,927,567

[45] Date of Patent: May 22, 1990

[54] MOTORLESS CONTINUOUS CARBONATOR

[75] Inventor: Arthur G. Rudick, Marietta, Ga.

[73] Assignee: The Coca-Cola Company, Atlanta, Ga.

[21] Appl. No.: 370,886

[22] Filed: Jun. 23, 1989

[51] Int. Cl.[5] ..... B01F 3/04

[52] U.S. Cl. ..... 261/35; 261/DIG. 7; 261/82; 261/104; 261/122

[58] Field of Search ..... 261/35, 82, 81, 104, 261/DIG. 7, 122

[56] References Cited

U.S. PATENT DOCUMENTS

| | | | |
|---|---|---|---|
| 1,126,662 | 1/1915 | Stuhler | 261/35 |
| 2,235,244 | 3/1941 | Ames et al. | 261/DIG. 7 |
| 2,604,310 | 7/1952 | Brown | 261/82 |
| 3,565,405 | 2/1971 | Black | 261/DIG. 7 |
| 4,098,852 | 7/1978 | Christen et al. | 261/104 |
| 4,304,736 | 12/1981 | McMillin et al. | 261/DIG. 7 |
| 4,781,889 | 11/1988 | Fukasawa et al. | 261/122 |
| 4,839,107 | 6/1989 | Rudick et al. | 261/DIG. 7 |
| 4,859,376 | 8/1989 | Hancock et al. | 261/DIG. 7 |

*Primary Examiner*—Tim Miles

*Attorney, Agent, or Firm*—Birch, Stewart, Kolasch & Birch

[57] ABSTRACT

A motorless continuous carbonator including a double acting piston type water pump driven by a double acting piston type gas pump actuator assembly powered by the carbonating gas. A connecting rod couples the pump piston with the actuator piston and includes means for operating a toggle switch mechanism for controlling a pair of solenoid valves respectively connected to the pump and actuator assembly for controlling the flow of water and carbonating gas, typically $CO^2$, therefrom and thus deliver still water and $CO^2$ to a semi-permeable membrane carbonator. The $CO^2$ gas which initially provides the pumping force is subsequently fed to the carbonator where it is absorbed by the still water to form carbonated water which is then fed to a dispensing unit which may be either a post-mix dispenser utilized either on earth or in a microgravity environment.

16 Claims, 3 Drawing Sheets

MOTORLESS CONTINUOUS CARBONATOR

BACKGROUND OF THE INVENTION

This invention relates generally to carbonating apparatus for use in connection with post-mix beverage dispensing systems and more particularly to a pneumatically driven pump system for delivering water to a carbonator.

Various types of apparatus for making and dispensing carbonated water for a post-mix dispensing system or a microgravity dispenser are generally well known. Such apparatus normally falls into two categories, one being a motor driven pump type carbonator assembly, while the other comprises a motorless or pneumatic pump driven assembly. In a motor driven carbonator, the water in the carbonator tank is mixed with carbon dioxide gas from a pressurized source and the water level in the tank is sensed and a pump motor is turned on and off on demand to deliver uncarbonated or "still water" into the tank, depending upon the sensed level. A motorless delivery system, on the other hand, typically uses a pneumatic pump. In such apparatus, the pump includes a single or double acting piston assembly which is reciprocated to pump water into the carbonator depending upon the level of the water present in the carbonator tank. In each instance, the carbonated water is then fed to a dispensing valve where the carbonated water is mixed with a measured amount of beverage concentrate or syrup to provide a carbonated beverage.

SUMMARY OF THE INVENTION

It is an object of the present invention, therefore, to provide an improved apparatus for making and dispensing carbonated water.

It is a further object of the invention to provide an improved apparatus for dispensing carbonated water in a post-mix beverage dispenser.

It is yet another object of the invention to provide an improvement in a motorless carbonator unit for a post-mix beverage dispenser.

And yet a further object of the invention is to provide an improvement in a carbonator for a carbonated beverage dispenser utilizing a pneumatically driven water pump.

And still a further object of the invention is to provide a pneumatically driven water pump in a carbonator which utilizes the carbonating gas as the power source for the pump.

And still another object of the invention is to provide a pneumatically driven motorless carbonator which vents little or no gas into the atmosphere.

The foregoing and other objects are realized by a motorless continuous carbonator including a double acting water pump driven by and connected to a double acting $CO^2$ gas powered pump actuator assembly. A connecting rod couples the actuator assembly with the water pump and includes a means for operating a toggle switch mechanism for controlling a pair of solenoid valves respectively connected to the pump and gas piston assembly for controlling the flow of water and $CO^2$ gas therefrom and thus deliver still water to a semi-permeable membrane carbonator. The $CO^2$ gas which initially provides the pumping force, is subsequently fed to the carbonator where the still water and $CO^2$ are mixed and fed to a post-mix dispensing unit which may be used either on earth or in a microgravity environment.

BRIEF DESCRIPTION OF THE DRAWINGS

A more complete understanding cf the invention will be had by referring to the following detailed description when taken in conjunction with the accompanying drawings wherein.

DETAILED DESCRIPTION OF THE INVENTION

Figure 1:
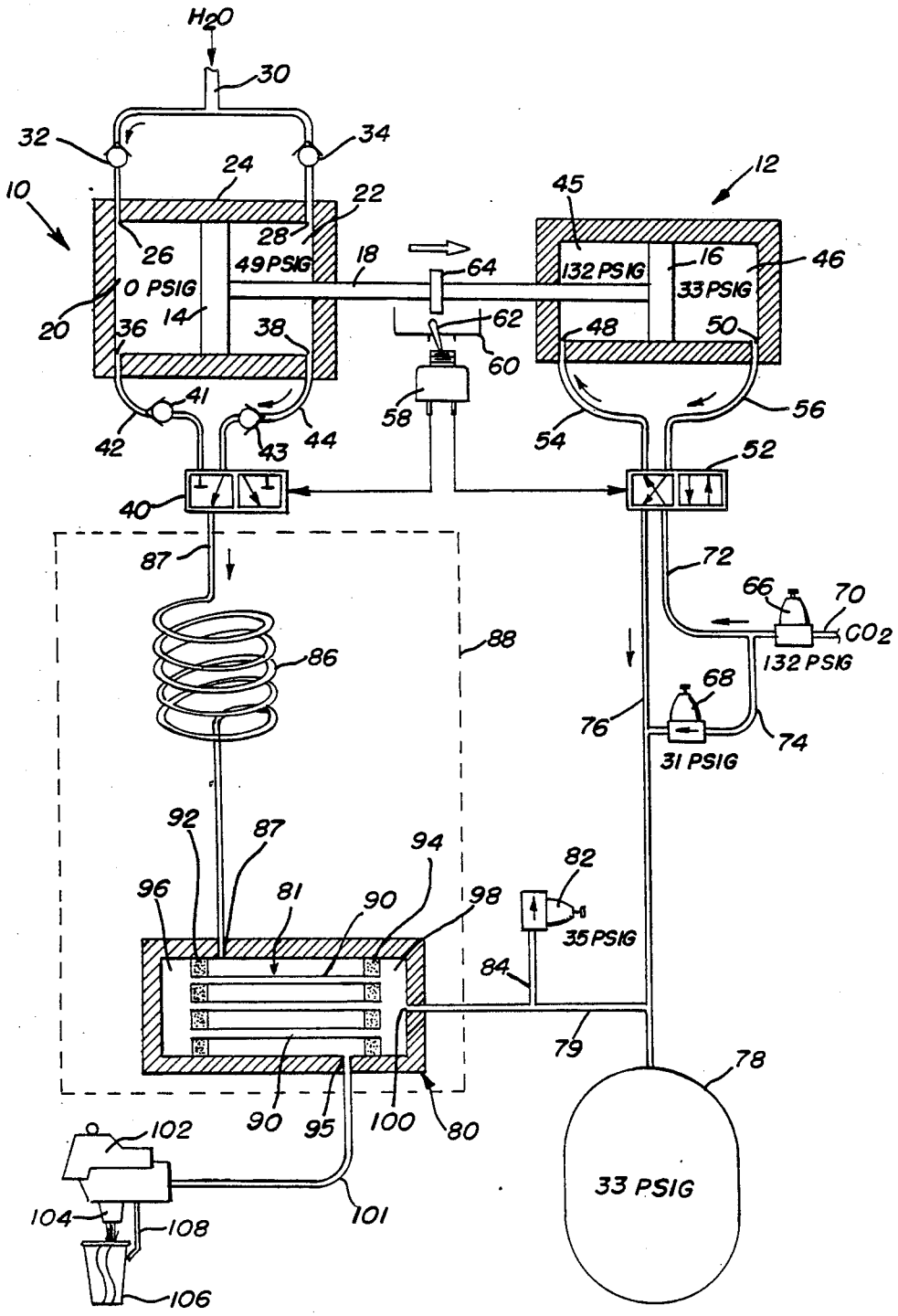
FIG. 1 is a mechanical schematic diagram illustrative of the preferred embodiment of the invention.

Referrring now to the drawings and more particularly to FIG. 1, reference numeral 10 denotes a double acting piston type water pump, while reference numeral 12 denotes a double acting piston type gas driven pump actuator. The water pump 10 includes a relatively large piston element 14 connected to a relatively smaller piston element 16 in the actuator 12 by means of a rigid connecting rod 18.

The water pump 10 further includes a pair of pump chambers 20 and 22 within a cylindrical housing 24 on either side of the piston 14. Still water, i.e. uncarbonated water, is fed into the two pump chambers 20 and 22 via a pair of input ports 26 and 28 which are connected to a water supply line 30 through a pair of one way check valves 32 and 34. A separate pair of output ports 36 and 38 are provided on the other side of the pump chambers 20 and 22 and are coupled to two input ports of a three way solenoid operated fluid valve device 40 by means of output lines 42 and 44 and wherein the two input ports are alternately connected to a single output port.

With respect to the pump actuator 12, it is comprised of a cylindrical housing 42 for the piston 16 and further includes a pair of gas chambers 45 and 46 separated by the piston and where carbonating gas, for example carbon dioxide ($CO^2$) is alternately introduced under pressure e.g. 132 psig., and thereafter fed out therefrom at a reduced pressure, e.g. 33 psig., by way of a pair of common input-output ports 48 and 50. The input-output ports 48 and 50, in turn, are coupled to a four way solenoid operated fluid valve device 52 by means of a pair of gas lines 54 and 56. The valve 52 includes two pairs of ports which are alternately cross-connected together.

The two solenoid valves 40 and 52 have their fluid flow alternately reversed by means of a toggle switch mechanism 58 which is actuated in accordance with the reciprocatory motion of the connecting rod 18. As shown in FIG. 1, a mechanical bracket 60 operates to toggle the switch lever 62. The bracket 60, in turn, is moved back and forth by means of a raised portion 64 of the connecting rod 18.

$CO^2$ gas is fed from a source, such as a cylinder, not shown, through a gas regulator 66 to both the valve 52 and a second regulator 68. The regulator 66 is set at, for example, 132 psig. while the regulator 68 is set at, for example, 31 psig. Further as shown, a gas inlet line 70 connects input $CO^2$ to the regulator 66, while two output branch lines 72 and 74 connect from the regulator 66 to the input port of solenoid valve 52 and the regulator 68, respectively. The output port of the solenoid valve 52 and the output of the low pressure regulator 68 are commonly connected to a feed line 76 which connects to a gas accumulator 78 and a feed line 79 which leads to a carbonator 80. A pressure relief valve 82 set at, for example, 35 psig., is connected to the accumulator 78 which is designed for 33 psig. by way of a branch line 84.

Also as shown in FIG. 1, the water pump output from the three port valve 40 is connected to a pre-chiller coil 86 located within chiller apparatus including a water bath 88 and which also includes the carbonator unit 80 therein.

The carbonator 80 includes a semi-permeable membrane carbonator assembly 81 comprised of a bundle of hollow semi-Permeable membrane fibers 90. The semi-permeable membrane fibers 90 are mounted between a pair of support members 92 and 94 to provide a pair of $CO^2$ plenum chambers 96 and 98 at opposite ends thereof with $CO^2$ being fed into the right-hand chamber 98 by way of an input port 100 located at the end of the $CO^2$ feed line 79 connected between the accumulator 78 and the carbonator 80.

Pre-chilled still water from the coil 86 is fed into the housing of the carbonator 80 by way of a fluid input port 87 where it flows around and past the semi-permeable membrane fibers 90 to an output port 95 while being separated from the $CO^2$ plenum chambers 96 and 98 by the support members 92 and 94.

An output line 101 feeds carbonated water from the semi-permeable membrane carbonator 80 to a post-mix dispensing head 102 where carbonated water from the carbonator is mixed with a measured amount of beverage concentrate or syrup, not shown, where it is dispensed from a nozzle 104 into a container 106 when a lever 108 is actuated.

Considering now the operation of the invention, if 10.5 cu.in. of $CO^2$ gas at 132 psig. and 60° F., is dissolved into 21 cu.in. of water, the water will contain 5 volumes of carbonation. Assuming that the piston area 14 is twice that of the piston area of piston 16, and being 12 sq.in. and 6 sq.in., respectively, such a system will measure out the above amount of water and $CO^2$ with each stroke of the respective double acting mechanisms 10 and 12.

With reference to FIG. 1, with the solenoid valve 52 being in the position as shown, pressurized $CO^2$ from the regulator 66 will be coupled into the left side piston chamber 44 at, for example, under 132 psig. This provides a pump actuating force to the right causing $CO^2$ in the right hand chamber 46 to be forced into the outlet line 56 as shown where it is coupled into the outlet line 76. Simultaneously, still water, previously drawn into the piston chamber 22 of the pump 10, is forced out of the output port 38 and into the water line 44 where it passes through the check valve 43, then through the three way solenoid valve 40 into the pre-chiller coil 86. As both interconnected pistons 14 and 16 move to the right, still water is drawn into the left side pump chamber 20 through the check valve 32 with a pressure potentially as low as 0 psig. When the pistons 14 and 16 near the right end of their stroke, the bracket 60 adjacent the connecting rod 18 activates the toggle switch lever 62, causing the switch 58 to reverse the flow through both solenoid valves 40 and 52.

Figure 2:
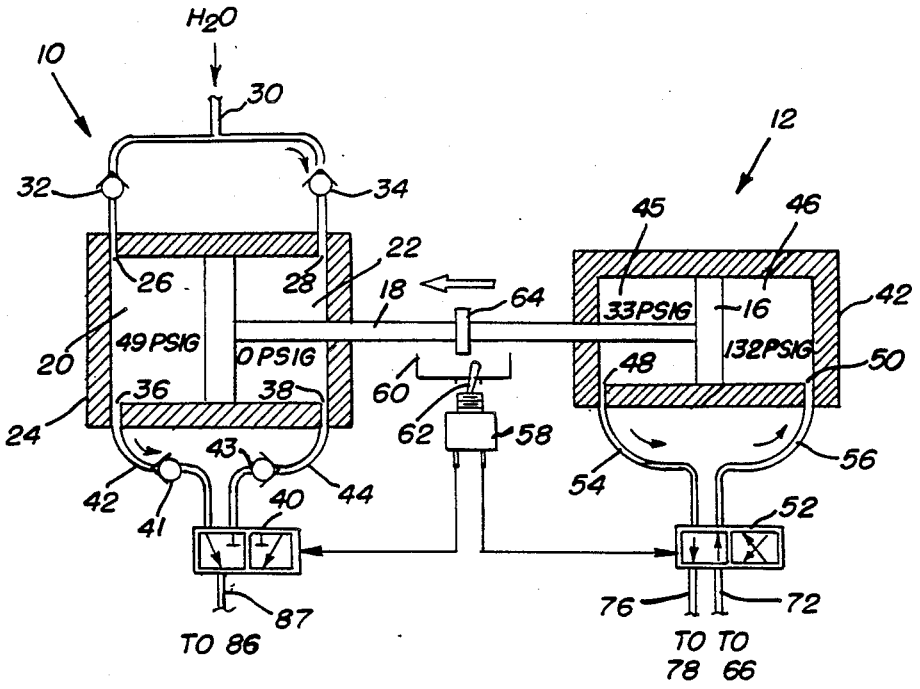
FIG. 2 is a partial mechanical schematic diagram of the embodiment shown in FIG. 1 for providing a better understanding of the invention.

Then as shown in FIG. 2, pressurized gas is fed into the right chamber 46 of the pump actuator 12 which urges the piston 16 to the left along with the piston 14 of the water pump 10. This action forces $CO^2$ out of the left hand chamber 44 and water out of the left hand pumping chamber 20 as shown while drawing water into the right hand chamber 22. When the pistons 14 and 16 near the left end of the stroke, the switching mechanism including the toggle switch 58, again reverses the valving of the solenoid valves 40 and 52 and the cycle repeats.

This action will continue so long as a dispensing valve, not shown, located in the dispensing head 102 is opened by actuation of the lever 108. When the dispensing valve closes, however, the system achieves a static equilibrium condition and the pistons 14 and 16 cease their reciprocatory movement until such time that the dispensing valve is reopened.

Still water pumped through the chiller coil 86 and into the semi-permeable membrane assembly is carbonated as it passes over membrane fibers 90 located inside of the carbonator housing. Carbon dioxide contained in the fibers 90 of the carbonator will pass through the fiber walls, however, water cannot. As long as the water pressure outside the fibers is greater than or equal to the $CO^2$ pressure inside the fibers 90, $CO^2$ will dissolve directly into the water without formation of bubbles. The maximum amount of $CO^2$ that can be absorbed by the water is a function of water temperature and $CO^2$ pressure while being independent of water pressure.

The accumulator 78 couples $CO^2$ to the plenum chamber 98 and to the inside of the fibers 90 at a relatively constant pressure. It should also be noted that the accumulator 78 is designed to be large enough to absorb the pressure spikes which will occur after each valve reversal of the solenoid valve 52. Accordingly, the pressure inside the accumulator 70 will remain, for example, between 31 and 35 psig. With water at 35° F., for example, $CO^2$ at 31 psig will produce a theoretical absolute carbonation of 5.0 volumes.

If the pressure drops below 31 psig., the regulator 68 which is set at 31 psig., for example, and connected to the accumulator 78 via the feedline 76, will supply extra $CO^2$ from the output of the source regulator 66 to return the internal pressure in the accumulator 78 to 31 psig. If, on the other hand, the pressure inside the accumulator 78 exceeds 35 psig., the excess pressure vents off through the pressure relief valve 82. By fine tuning the settings of the pressure regulator 68 and the pressure relief valve 82, the carbonator can be made to operate while venting very little or no $CO^2$ to the atmosphere.

Having thus shown and described what is at present considered to be the preferred embodiment of the invention, it should be noted that the same has been made by way of illustration and not limitation. Accordingly, all alterations, changes and modifications coming within the spirit and scope of the invention as set forth in the appended claims are herein meant to be included.

I claim:

1. A motorless carbonator for carbonated drink dispenser means, comprising:

a double acting water pump including a pair of pump chambers separated by a reciprocatory pumping member, means for feeding still water alternately in and out of said pump chambers;

a double acting gas activated pump actuator including a pair of gas chambers separated by a reciprocatory actuator member powered by a differential gas pressure in said pair of gas chambers;

means for feeding carbonating gas alternately into said gas chambers at a relatively high pressure and out of said gas chambers at a relatively low pressure;

means for mechanically connecting said reciprocatory pumping member of said pump to said reciprocatory actuator member of said pump actuator;

a carbonator assembly including a plurality of hollow semi-permeable membrane fibers coupled to said relatively low pressure carbonation gas out of said gas chambers and being located in a housing having a still water input port and a carbonated water output port, and wherein said carbonating gas passes through said semi-permeable membrane fibers and dissolves into still water fed from said pump to said input port to form carbonated water which is fed to said output port; and means connected to said output port of said carbonator assembly for feeding carbonated water to said drink dispensing means.

2. The carbonator as defined by claim 1 wherein said means for feeding still water in and out of said pump chambers comprise a respective input port and output port in said chambers.

3. The carbonator as defined by claim 2 and additionally including a pair of one way check valves respectively connected between a source of still water and said input ports.

4. The carbonator as defined by claim 2 and additionally including a three port fluid valve actuated in response to the reciprocal motion of said mechanical connecting means and including a pair of input ports respectively coupled to the output ports of said pump chambers and a single output port alternately coupled between the valve input ports and said still water input port of said carbonator assembly.

5. The carbonator as defined by claim 4 and additionally including water chiller means located between said three port fluid valve and said means for feeding carbonated water to said dispensing means.

6. The carbonator as defined by claim 5 wherein said chiller means includes a chiller coil connected between said single output port of said three port fluid valve and said still water input port of said carbonator assembly, and additionally including means for cooling said coil assembly.

7. The carbonator as defined by claim 6 wherein said chiller means further includes a water bath and wherein said chiller coil and said carbonator assembly are located in said water bath.

8. The carbonator as defined by claim 1 wherein said means for feeding carbonating gas into and out of said gas chamber comprises a common input-output chamber port located in each of said pair of gas chambers and additionally including a four port fluid valve actuated by the reciprocatory movement of said mechanical connecting means, said valve having a single input valve port, a single output valve port and a pair of input-output valve ports alternately coupled between said input valve port and said output valve port, and wherein said pair of input-output valve ports are connected to a respective common input-output chamber port, said input valve port being further coupled to a source of carbonating gas and wherein said output valve port is coupled to said plurality of semi-permeable membrane fibers of said carbonator assembly.

9. The carbonator as defined by claim 8 and additionally including gas accumulator means for said relatively low pressure gas out of said pump actuator and being coupled between said output valve port of said fluid four port valve and said plurality of semi-permeable membrane fibers of said carbonator assembly.

10. The carbonator as defined by claim 9 and additionally including means for feeding carbonating gas from said source of carbonating gas when the pressure within the accumulator means falls below a predetermined pressure.

11. The carbonator as defined by claim 9 and additionally including means for venting off gas pressure from said accumulator means when the internal pressure therein exceeds a predetermined pressure.

12. The carbonator as defined by claim 1 wherein said means for feeding still water alternately in and out of said pump chambers comprises a separate input port and output port in both said pump chambers, wherein said means for feeding carbonating gas alternately into and out of said gas chambers includes a common input-output port in both said gas chambers; and additionally including a three port fluid valve having a single output port and a pair of input ports alternately coupled to said output port, and wherein said pair of input ports are respectively coupled to said output ports of said pump chambers and said output port is coupled to said still water input port of said carbonator assembly;

a four port fluid valve having a single input port, a single output port, and a pair of input-output ports alternately coupled between said input port and said output port thereof, and wherein said pair of input-output ports are respectively coupled to said common input-output ports of said gas chambers, said single input port is coupled to a source of carbonating gas and said output port is coupled to said plurality of hollow semi-permeable membrane fibers of said carbonator assembly and means responsive to the reciprocatory motion of said pumping member and said actuator member for actuating both fluid valves alternately between first and second operating states.

13. The carbonator as defined by claim 12 wherein said means for actuating said fluid valve includes switch means operated by said means for mechanically connecting the reciprocatory pumping chamber to said actuator member.

14. The carbonator as defined by claim 13 and additionally including gas accumulator means connected between said output port of said four port fluid valve and said plurality of semi-permeable membrane fibers of said carbonator assembly.

15. The carbonator as defined by claim 14 and additionally including regulator means for feeding carbonating gas to said accumulator from a source of carbonating gas when the pressure in said accumulator means falls below a predetermined minimum pressure.

16. The carbonator as defined by claim 15 and additionally including means for venting pressure from said accumulator means when the pressure exceeds a predetermined pressure.

* * * * *